United States Patent [19]

Voith

[11] Patent Number: 4,712,264

[45] Date of Patent: Dec. 15, 1987

[54] MODULAR STEP RAMP

[76] Inventor: Thomas P. Voith, 666 Wall St., West Hempstead, N.Y. 11552

[21] Appl. No.: 912,821

[22] Filed: Sep. 29, 1986

[51] Int. Cl.[4] ..... E01D 1/00

[52] U.S. Cl. ..... 14/69.5; 193/41; 238/10 R

[58] Field of Search ..... 14/1, 69.5, 72.5; 193/38, 41; 238/10 R; 254/88; 414/537

[56] References Cited

U.S. PATENT DOCUMENTS

| | | | |
|---|---|---|---|
| 299,376 | 5/1884 | Given | 193/41 X |
| 484,086 | 10/1892 | Cassidy | 193/41 |
| 981,613 | 1/1911 | Carter | 14/69.5 X |
| 1,505,116 | 8/1924 | Wiebe | 238/10 R |
| 2,141,529 | 12/1938 | Gravelle | 14/69.5 |
| 2,312,273 | 2/1943 | Stochmal | 238/10 R |
| 3,009,183 | 11/1961 | Lay | 14/69.5 |
| 3,487,489 | 1/1970 | Kuhns | 14/69.5 |
| 4,368,553 | 1/1983 | Perry | 14/69.5 |
| 4,528,711 | 7/1985 | Packer | 14/69.5 |

*Primary Examiner*—Stephen J. Novosad
*Assistant Examiner*—John F. Letchford
*Attorney, Agent, or Firm*—Brady, O'Boyle & Gates

[57] ABSTRACT

A ramp for stairways is constructed from a plurality of separate right triangular modules which individually nest in the recesses of the stairway formed by the step treads and risers. The several modules are securely releasably interconnected on opposite sides thereof by tethered locking pins received by registering locking apertures of male and female connector elements. The continuous stairway ramp formed by two parallel groups of modules is laterally adjustable through connector slides on the riser walls of the modules. Two parallel ramp trackways are formed having opposite side upstanding lips and the surfaces of the trackways are covered with a grooved rubber matting to facilitate the passage of hand trucks and wheelchairs smoothly along the ramp.

16 Claims, 11 Drawing Figures

MODULAR STEP RAMP

BACKGROUND OF THE INVENTION

1. Technical Field

The present invention relates broadly to stairway ramps and more particularly relates to a modular ramp for stairways of any required length.

2. The Prior Art

Heretofore, stairway ramps have been rather crude devices ranging from a simple pair of laterally adjustable parallel tracks of fixed length in U.S. Pat. No. 1,505,116 to length-adjustable stairway ramps in U.S. Pat. Nos. 3,009,183 and 4,528,711.

No one in the prior art appears to have recognized the important advantage from a safety and stability viewpoint of utilizing the right angular recesses formed by the treads and risers of steps to seat a stairway ramp so that the same cannot slide dangerously on the stairway. In attempting to deal with this in the prior art cumbersome extensions are sometimes provided on the ends of the ramp to engage level floor surfaces and resist slipping, as in U.S. Pat. Nos. 981,613 and 3,009,183.

The present invention involves two major advances in the construction of stairway ramps for hand trucks, wheelchairs and the like, the first of which is forming the ramp in multiple right triangular hollow sections which nest securely into the recesses formed by the steps and the second of which is the formation of the stairway ramp in separate easily connectable and separable step modules which collectively form a pair of parallel laterally adjustable continuous inclined ramp trackways along a stairway of any required length.

The stairway ramp according to the present invention is therefore much safer than known prior art ramps in that it cannot slip along the stairway. The necessity for floor-engaging end terminals on the ramp is eliminated. Moreover, the ramp is much more versatile than prior art types due to its modular construction whereby it can be installed on very short or very long stairways and dismantled for much more compact storage.

Other important features and objects of the invention will become apparent to those skilled in the art during the course of the following detailed description.

SUMMARY OF THE INVENTION

The present invention is best summarized as a modular ramp for stairways of any length formed in two parallel laterally adjustable sections having continuous track surfaces. Each ramp section consists of a plurality of step modules constructed to nest in the recesses of a stairway formed by the step tread and riser surfaces. The modules of each ramp section are releasably securely connected on their opposite sides by interfitting male and female connectors secured by removable locking pins. The corresponding modules of the two ramp sections are laterally adjustably connected across the riser walls of the modules by interfitting slotted slide members attached to the riser walls and adapted to be locked in selected adjusted positions by screws and wing nuts or the like.

DETAILED DESCRIPTION

Figure 1:
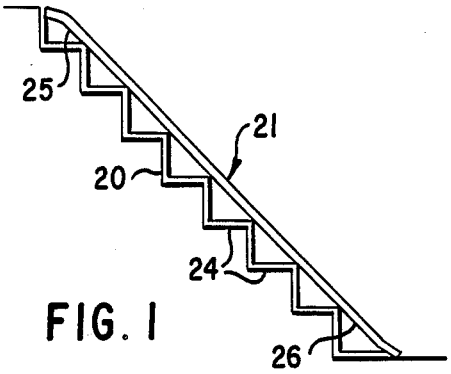
FIG. 1 is a side elevation of an assembled modular stairway ramp according to the present invention.
Figure 2:
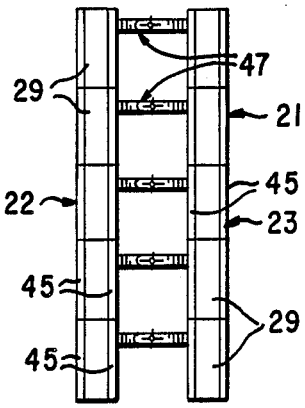
FIG. 2 is a front elevation of the ramp in FIG. 1.

Referring to the drawings in detail wherein like numerals designate like parts, FIG. 1 depicts a stairway 20 to which an assembled modular step ramp 21 according to the invention is applied. FIG. 2 shows that the modular step ramp is constructed in two parallel ramp sections 22 and 23, each of which consists of a plurality of separately formed intermediate step modules 24 whose number will vary depending on the length of the stairway 20, a top step module 25 and a bottom step module 26.

As best shown in FIG. 1, a key feature of the invention is the ability of the ramp step modules 24, 25 and 26 to be seated or nested in the right angular recesses formed by the treads and risers of the stairway steps. This renders the stairway ramp extremely safe because it cannot slip along the stairway. A second key feature is the modular construction of the ramp sections 22 and 23 which allows the ramp to be installed on a stairway of any length, short or long.

Each individual ramp module as viewed from the side is right triangular and includes a rear riser wall 27, a bottom tread wall 28 and a forward inclined hypotenuse or ramp track wall 29. Referring to FIG. 2, when the individual ramp modules are properly connected in assembled relationship by means to be described, the walls 29 form two parallel continuous trackways for the wheels of hand trucks, wheelchairs or the like, enabling these vehicles to be pulled and guided along a stairway by an attendant who can use the unobstructed portions of the stairway steps between the ramp sections 22 and 23.

The step modules are preferably formed of strong lightweight metal alloy. They can be sized to fit all standard stairway steps as well as those having unusual dimensions.

An important feature of the invention comprises a means to rigidly and releasably connect the adjacent step modules of the ramp sections 22 and 23. This connecting means is provided on each side of each module. For each intermediate step module 24, the connecting means comprises an upper female tubular connector element 31 on each side of the module 24 and a lower male connector element 32 on each side. Each male connector element 32 includes a relatively long plug 33, fixedly held within one end of a tubular body 34 which extends along one side of the step module immediately below and outwardly of and parallel to the inclined wall 29. The plug 33 is secured by a screw 35 to the connector body 34 and this screw also penetrates a mounting strap 36 suitably anchored to the horizontal tread wall 28 and rising therefrom near the lower corner of the triangular module.

Each female connector element 31 contains a shorter plug 37 secured in the connector body 34 by a screw 38 which also penetrates a mounting strap 39 securely fixed to the riser wall 27. The mounting straps 36 and 39 on each side of the step module preferably have bent-over top tabs 40, also shown in FIG. 8 in connection with the top step module 25. These tabs 40 are secured to the inclined wall 29 by screws or by welding. Thus, the mounting straps 36 and 39 near the upper and lower corners of each module, on each side thereof, tie the connector bodies 34 and their male and female connector elements to the riser wall 27 and also to the inclined wall 29, rendering the module rigid and strong.

Figure 3:
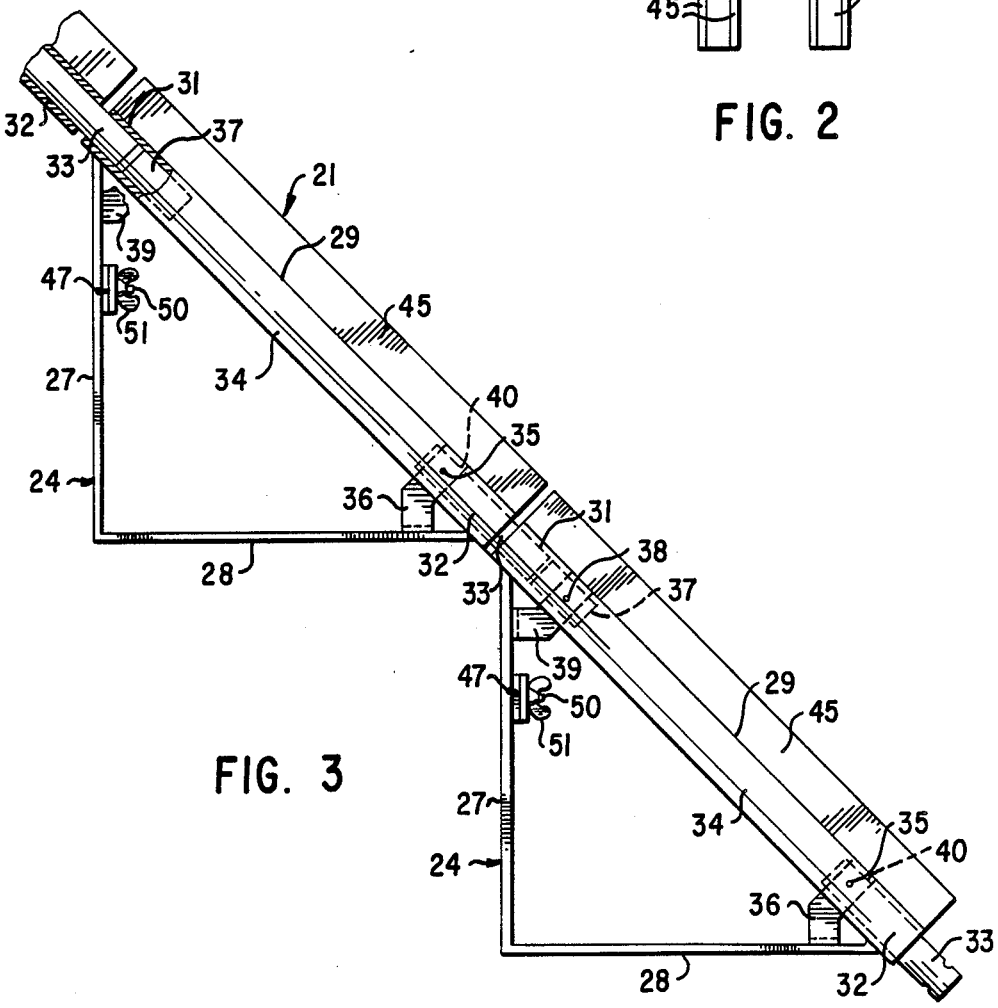
FIG. 3 is an enlarged fragmentary side elevation, partly in section, showing an adjacent pair of connected intermediate step ramp modules.

As shown in FIG. 3, the plug 33 of each male connector element 32 enters the adjacent female connector element 31 of the next lowermost intermediate module 24. The plugs 37 of the female connector elements provide a limiting or stopping point for the male plugs 33 and give added strength to the connection.

Figure 4:
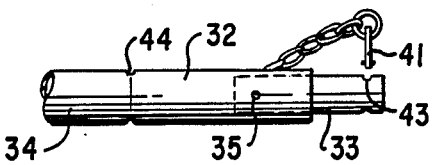
FIGS. 4 and 5 are fragmentary side elevational views of male and female step ramp connector elements.
Figure 5:
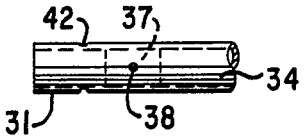

A tethered locking pin 41 attached to each male connector element 32, FIG. 4, is placed through registering holes 42 and 43 of the female connector element 31 and plug 33 following telescoping engagement of these parts. The holes 42 and 43 extend from top-to-bottom through the elements 31 and 33. A storage hole 44 for the locking pin 41 is preferably formed in each connector body 34 somewhat rearwardly of the plug 33.

A pair of upstanding parallel longitudinal guide flanges 45 is formed along the opposite longitudinal edges of each inclined wall 29 to provide a continuous guiding trackway along each ramp section 22 and 23 for the wheels of hand trucks, wheelchairs or the like, while negotiating the stairway ramp. The top face of each wall 29 between its flanges 45 is provided with a friction covering 46, FIG. 8, of rubber or the like, which covering is preferably grooved longitudinally of the stairway ramp.

Figure 6:
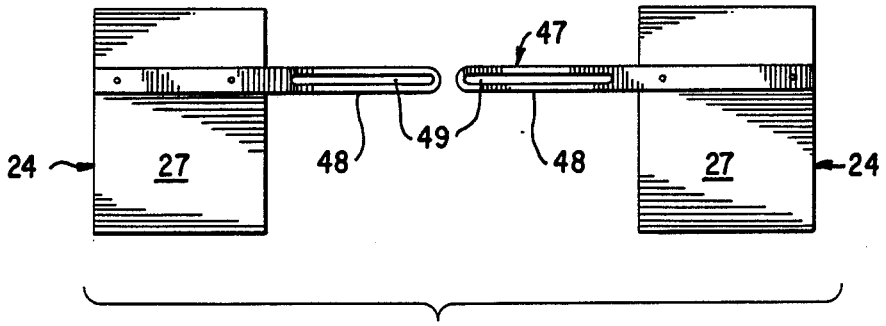
FIG. 6 is a front elevation of a laterally adjustable connector means between adjacent modules of the two parallel sections of the ramp.

Another important feature of the invention is the provision of a lateral interconnecting and adjusting means 47 between the ramp sections 22 and 23, FIG. 2. Referring to FIG. 6, this means comprises a slotted horizontal bar 48 on each module rigidly attached to the riser wall 27 thereof near and below the top of the module and projecting laterally inwardly thereof. With this arrangement, the adjusting slots 49 of the two bars 48 may register to receive therethrough a locking screw 50 carrying a clamping wing nut 51, as shown in the drawings. By this convenient means, the two ramp sections 22 and 23 can be adjusted laterally and locked to accommodate vehicles having various tread widths. Since the lateral adjusting means 47 is located on the riser wall 27, it is well out of the way and does not obstruct the stairway between the ramp sections 22 and 23. Therefore, the center of the stairway is available to the attendant for a hand truck or wheelchair.

Figure 7:
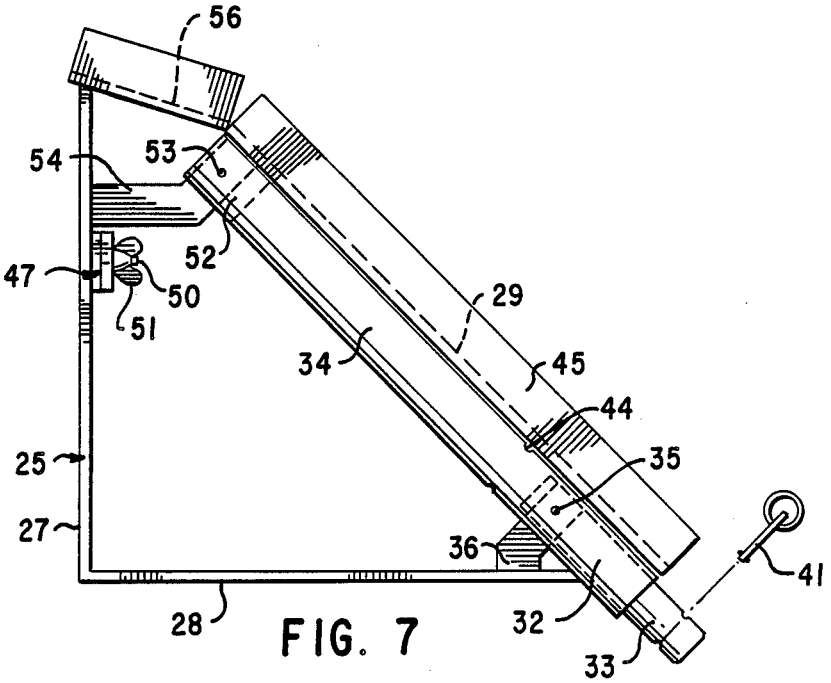
FIG. 7 is a side elevation of a top step module of the stairway ramp.
Figure 8:
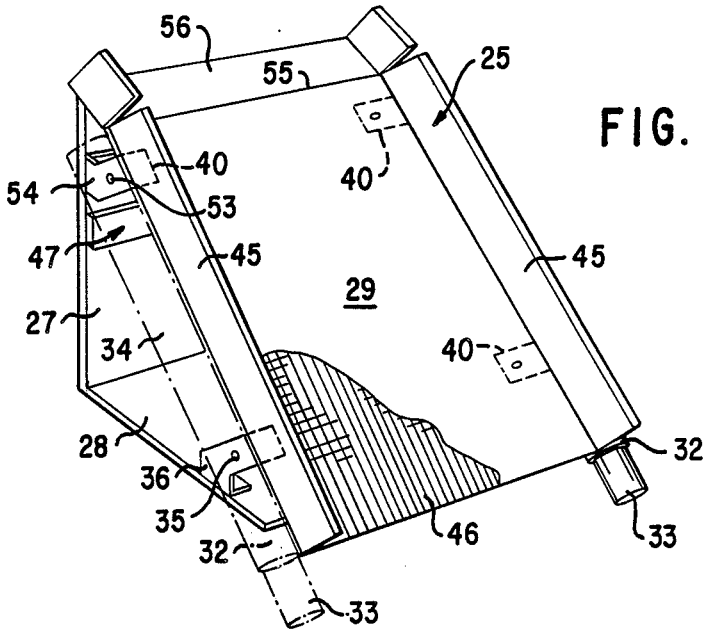
FIG. 8 is a perspective view thereof.

FIGS. 7 and 8 show the top step module 25 of each ramp section which is similar to the described intermediate step module 24 but differs therefrom in some particulars. The top step module 25 is slightly shallower at the riser wall than the intermediate module 24 but has the same width along the tread wall 28. Since there is no module above the top step module 25, the female connector at the top of the module 25 is omitted. At its lower end, however, the same male connector element 32 and associated elements previously described for the intermediate module 24 is present.

In the top step module 25, a plug 52 is secured by a screw 53 in the upper end portion of the connector body 34 and this screw penetrates a mounting strap 54 structurally tied between the riser wall 27 and inclined wall 29 as in the intermediate modules 24.

In the top step module 25, there is a bend or break 55 in the wall 29 near and below the top of the module 25 to form a short transition ramp 56 of lesser slope than the wall 29 onto the level floor at the top of the stairway.

Figure 10:
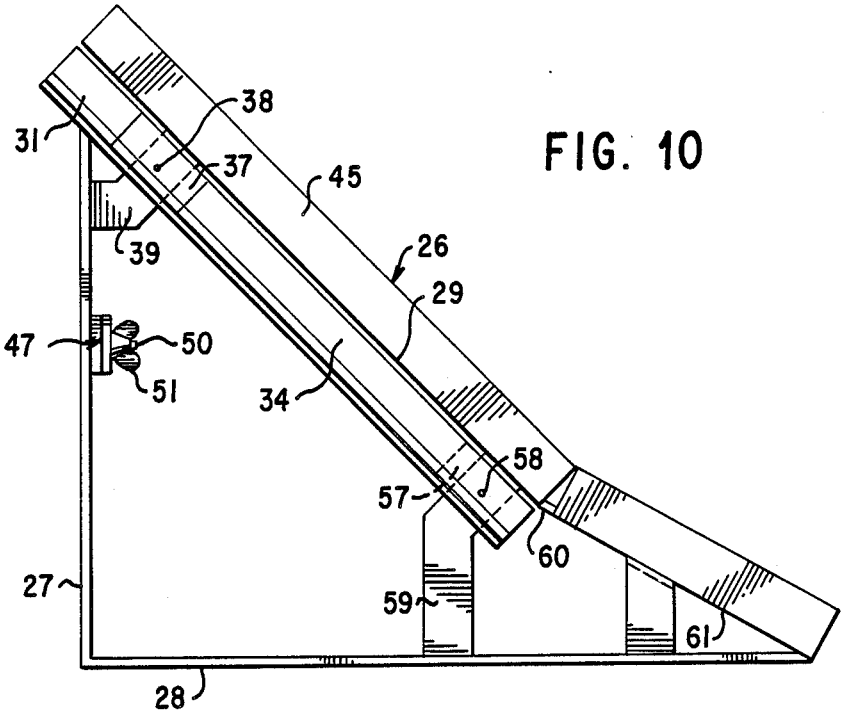
FIG. 10 is a similar view of a bottom step module.

FIG. 10 shows the bottom step module 26 which includes at its top the described female connector element 31 to receive the plug 33 of the next uppermost intermediate step module 24. The bottom step module 26 requires no male connector element at its lower end and therefore this element is omitted.

The lower end of the connector body 34, FIG. 10, is equipped with a plug 57 and receives therethrough a screw 58 which also penetrates a mounting strap 59 rising from the tread wall 28 at each side of the bottom step module 26.

Near its bottom, the module 26 has a transverse bend 60 forming a less steeply inclined entrance ramp portion 61 to facilitate the initial guidance of a loaded vehicle onto the stairway ramp 21.

Figure 9:
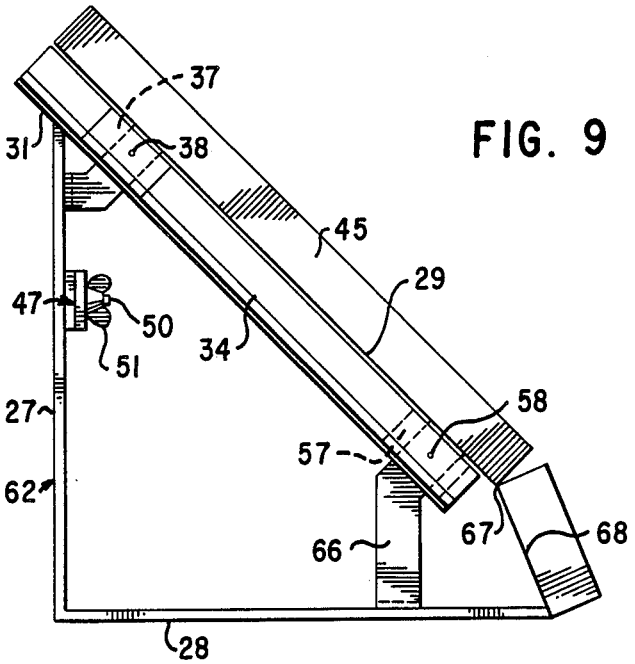
FIG. 9 is a side elevation of an intermediate bottom step module.
Figure 11:
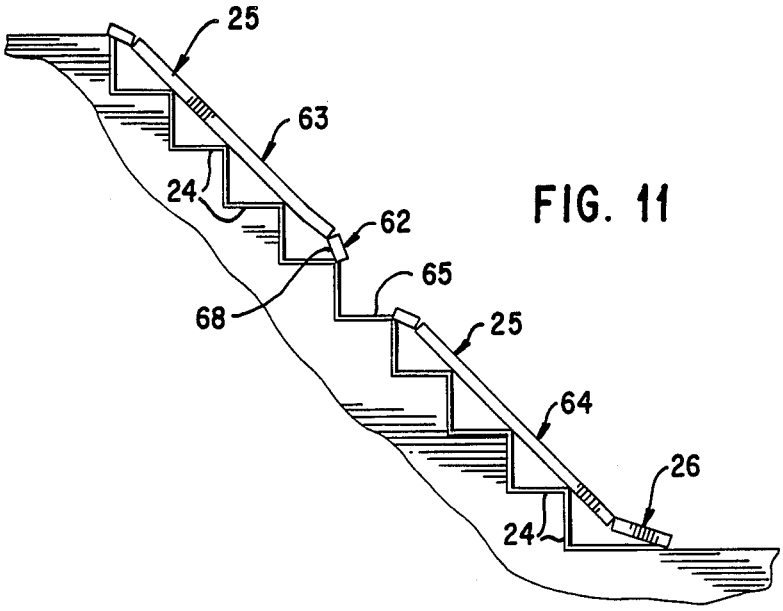
FIG. 11 is a side elevation of a two-part modular stairway ramp allowing an intermediate rest point in the stairway.

FIG. 9 depicts an intermediate bottom step module 62 also shown in FIG. 11. In FIG. 11, two separated stairway ramp portions 63 and 64 are illustrated leaving one intermediate step 65 of a long stairway unbridged by the ramp to form a rest point for a user of the ramp. The lower ramp portion 64 includes a bottom step module 26 and top step module 25, as above described and any required number of the intermediate modules 24. The upper ramp portion 63 includes the described top step module 25, the required number of intermediate step modules 24, and the intermediate bottom step module 62.

Referring to FIG. 9, the module 62 includes an upper female connector element 31 to receive the plug 33 of an intermediate step module 24, but the lower end male connector element 32 is not required and is omitted. A mounting strap 66, similar to the strap 59 in FIG. 10, is provided, along with the screw 58 and associated plug 57, as previously described.

The module 62 near its bottom has a break point 67 forming a steeply inclined lower entrance ramp portion 68 by means of which a heavy load is more easily transferred onto the upper portion 63 of the two-part ramp above the rest point 65, FIG. 11.

The many advantages of the invention over the prior art having been explained, it should be understood that the form of the invention herewith shown and described is to be taken as a preferred example of the same, and that various changes in the shape, size and arrangement of parts may be resorted to, without departing from the spirit of the invention or the scope of the subjoined claims.

I claim:

1. A stairway ramp comprised of a plurality of modules constructed to fit into right angular recesses as defined by the treads and risers of a set of stairway steps, each said module being used in pairs comprising tread and riser walls connected at their inner ends at a substantially right angle so as to abut the tread and riser of a respective step, means adapted to be traversed by a wheeled load and being connected with said tread and riser walls of the module at the upper ends thereof, and coupling means at least on one end of each module adjacent to one end of the said means adapted to be traversed for releasably connecting the module with another adjacent module of a stairway ramp.

2. A stairway ramp module as defined in claim 1 wherein said means adapted to be traversed by a wheeled load comprises an inclined wall, and wherein an upper end module of said plurality of modules has one end portion of said inclined wall near the top of the module bent relative to the remainder of the inclined wall to form an exit ramp portion of lesser slope at the top of said module for easier transition of a load from the module onto a level floor.

3. A stairway ramp module as defined in claim 1, wherein said means adapted to be traversed by a wheeled load comprises an inclined wall and wherein a module of said plurality of modules has said inclined wall bent near and above the tread wall of the module to define on the bottom of the module a steeply inclined entrance ramp portion which facilitates pulling a load upwardly onto the module.

4. A stairway ramp module as defined in claim 1, wherein said means adapted to be tranversed by a wheeled load comprises an inclined wall and wherein a lower end module of said plurality of modules has said inclined wall bent near and above the tread wall of the module to form on the bottom of the module a less steeply inclined entrance ramp portion which facilitates pulling a load from a level surface onto the module.

5. A stairway ramp module as defined in claim 1, and further comprising a substantially horizontal lateral connecting member on said riser wall of each module and projecting laterally outwardly from one side of the module. I3

6. A stairway ramp module as defined in claim 5, and coupling means on the opposite ends of the module adjacent to the ends of the inclined walls.

7. A stairway ramp module as defined in claim 6, and the coupling means comprising a pair of opposite side socket type coupling elements on the opposite ends of the module, the pair of coupling elements at one end of the module comprising male coupling elements, and the pair of coupling elements at the other end of the module comprising female coupling elements.

8. A stairway ramp comprising upper and lower separate ramp portions each adapted to be mounted on a stairway on opposite sides of an intermediate stairway step forming a rest point on the stairway, each ramp portion being formed from a plurality of detachably connected individual step modules shaped to fit within a respective recess defined by the tread and riser of a step of the stairway, both ramp portions including a plurality of intermediate step modules and each including a top step module having an upper exit ramp portion of reduced slope, the bottom ramp portion having a bottom step module having an entrance ramp portion of reduced slope, and the upper ramp portion including an intermediate bottom step module having an entrance ramp portion of increased slope, each said module further comprising an inclined surface member bridging said recess of a step of the stairway, a pair of straight wall members joined at a right angle and secured beneath the inclined surface member, and socket type end interconnecting means for releasably joining the modules of said ramp portion in end to end relationship.

9. A modular stairway ramp constructed to extend substantially for the full length of a stairway including a plurality of steps, said ramp comprising a plurality of intermediate step sections, a top section and a bottom section, each said section being comprised of at least one module per step, each module further including a substantially continuous inclined surface structure bridging the recess of a respective step formed by the tread and riser thereof, a pair of linear members joined at a right angle and secured beneath the inclined surface structure and being of a predetermined length to fit into the respective recess of a stairway step as defined by the length dimension of the tread and riser to support and stabilize the ramp on the stairway, and releasable substantially rigid end interconnecting means on said modules so that they may be joined end-to-end in assembled relationship to produce a ramp of required length.

10. A stairway ramp as defined in claim 9, and a covering of friction material on said inclined surface structure of said module.

11. A stairway ramp as defined in claim 9, wherein said surface structure inclues a pair of upstanding parallel longitudinal guide flanges.

12. A stairway ramp as defined in claim 9, and additionally including angular offset members respectively securing said pair of linear members to the inclined surface structure.

13. A stairway ramp as defined in claim 9, wherein each said section is comprised of two modules and means laterally adjustably interconnecting said two modules of each section so that the distance therebetween can be adjusted and fixed to fit the width of the stairway.

14. A stairway ramp as defined in claim 13 wherein said means interconnecting the two modules extend horizontally adjacent the respective riser of a step whereby the area of the stairway between the ramp sections remains substantially unobstructed.

15. A stairway ramp as defined in claim 9 wherein said end interconnecting means comprise interfitting male and female connector elements, and additionally including means to releasably lock said elements in interfitting relationship.

16. A stairway ramp as defined in claim 15, and wherein said connector elements have transverse through holes therein adapted to register with one another and wherein the locking means comprises a locking pin insertably removable in the through holes.

* * * * *